US006098834A

United States Patent [19]

Hatsumoto et al.

[11] Patent Number: 6,098,834

[45] Date of Patent: Aug. 8, 2000

[54] CAP FOR BEVERAGE CONTAINER

[75] Inventors: Kunio Hatsumoto; Yasuhiro Kowa; Takeshi Kuwana, all of Tokyo, Japan

[73] Assignee: Nippon Sanso Corporation, Tokyo, Japan

[21] Appl. No.: 09/242,127

[22] PCT Filed: Jun. 5, 1998

[86] PCT No.: PCT/JP98/02496

§ 371 Date: Feb. 9, 1999

§ 102(e) Date: Feb. 9, 1999

[87] PCT Pub. No.: WO98/56677

PCT Pub. Date: Dec. 17, 1998

[30] Foreign Application Priority Data

Jun. 11, 1997 [JP] Japan ..... 9-153472

[51] Int. Cl.[7] ..... A47G 19/22; B65D 25/28

[52] U.S. Cl. ..... 220/715; 220/212.5; 220/254; 220/756

[58] Field of Search ..... 220/715, 756, 220/212.5, 254; 222/484, 517, 556

[56] References Cited

U.S. PATENT DOCUMENTS

| | | | |
|---|---|---|---|
| 3,964,631 | 6/1976 | Albert | 220/715 |
| 3,967,748 | 7/1976 | Albert . | |
| 3,972,443 | 8/1976 | Albert | 220/715 |
| 4,094,433 | 6/1978 | Numbers | 220/715 |
| 4,099,642 | 7/1978 | Nergard . | |
| 4,212,408 | 7/1980 | Valenzona | 220/254 |
| 4,276,992 | 7/1981 | Susich . | |
| 4,303,173 | 12/1981 | Nergard . | |
| 5,427,271 | 6/1995 | Wang | 220/715 |

FOREIGN PATENT DOCUMENTS

| | | |
|---|---|---|
| 37-23176 | 9/1962 | Japan . |
| 52-9163 | 1/1977 | Japan . |
| 54-32554 | 3/1979 | Japan . |
| 62-131622 | 8/1987 | Japan . |
| 7-95907 | 4/1995 | Japan . |
| 7-251854 | 10/1995 | Japan . |

*Primary Examiner*—Stephen K. Cronin
*Attorney, Agent, or Firm*—Armstrong, Westerman, Hattori, McLeland and Naughton

[57] ABSTRACT

A drinking receptacle cover comprising a slant cover plate having a top surface and a bottom surface and covering a heat insulating cup at the open top; a rim surrounding the cover plate; a valve assembly having a valve element for opening and closing a spout formed at a lowest level portion of the cover plate adjacent to the rim; a push rod for operating the valve assembly; and a return spring for urging the push rod in the anti-actuating direction. The push rod is disposed to penetrate an insertion opening formed in the rim to be retractable along the bottom surface of the cover plate. An actuating lever which is engaged with the outer end of the push rod to advance it into the inside of the rim is pivotally located on the outer side of the rim. The actuating lever has an actuating section extending along the outer side of the receptacle. The valve assembly has an engaging arm to be engaged with the push rod and a closing arm having the valve element at the free end. The valve assembly is pivotally supported, by brackets protruding from the bottom surface of the cover plate, at the trunnions protruding from the lateral sides of the engaging arm.

3 Claims, 6 Drawing Sheets

CAP FOR BEVERAGE CONTAINER

TECHNICAL FIELD

The present invention relates to a drinking receptacle cover, more particularly to a drinking receptacle cover which permits drinking of water in the receptacle without removing the cover.

BACKGROUND ART

Covers of drinking receptacles which enable drinking of water contained in the receptacles without removing the covers are disclosed, for example, in Japanese Unexamined Patent Publication Nos. Hei 7-251854 and Hei 7-95907, and U.S. Pat. Nos. 4,099,642, 4,276,992 and 4,303,173.

These covers share a common constitution in that they each have a slant cover plate, with a top surface and a bottom surface, for covering a heat insulating receptacle at the open top and a rim surrounding the cover plate and that the cover plates each have a spout at the lowest level portion adjacent to the rim.

However, the cover disclosed in Japanese Unexamined Patent Publication No. Hei 7-251854 which is provided with a spout as described above and an air inlet has no closing member at the spout and air inlet. Accordingly, the spout and the air inlet are normally open, so that there is an apprehension in the heat insulating effect of the cover and that the water contained in the receptacle can leak through such openings, if the drinking receptacle is turned over inadvertently.

Meanwhile, the cover disclosed in Japanese Unexamined Patent Publication No. Hei 7-95907 is provided on the top surface of the cover plate with a pivotal stopper for opening and closing the spout. However, since this cover has no packing and is not of watertight structure, the temperature of water escapes through the clearance between the spout and the stopper, limiting its heat insulating effect. Further, if the drinking receptacle happens to be turned over, the water contained in the receptacle spills out. Besides, the operation of opening and closing the stopper by pivoting it on the top of the cover plate is not easy.

The covers disclosed in the above three U.S. Patents are each provided with a valve assembly having at the free end a valve element for closing the spout and a pair of resilient arms extended in the direction opposite to the valve element, and a push rod which has a cam surface formed at the free end and operates the valve assembly. The valve assembly is applied to the bottom surface of the cover plate with the aid of the resilient arms which urge the valve element to achieve watertight closure of the spout. The push rod penetrates an insertion opening formed in the rim to be retractable along the bottom surface of the cover plate, and the valve assembly is moved by the cam surface to be open by pushing the rear end protruding outward through the rim.

In the cover disclosed in U.S. Pat. No. 4,099,642, while the valve assembly and the push rod are oriented diametrically, one must grip the upper part of the receptacle having the greatest diameter when the rear end of the push rod protruding outward through the rim of the cover is pushed, so that the receptacle is too inconvenient to be held stably. In addition, since the rear end of the push rod is of relatively small size, it is hard to push directly with the thumb and requires some power.

In the covers disclosed in U.S. Pat. Nos. 4,276,99 and 4,303,173, the push rod is oriented orthogonal to the valve assembly and is designed to be pressed with a short lever provided on the rim.

If such covers are fitted on receptacles with handles, the lever is located above a handle, and thus the lever can be operated easily. However if the cover is fitted on a receptacle with no handle, the lever is hard to operate, because the spout and the lever are positioned at an angular interval of 90°.

It is an objective of the present invention to provide a drinking receptacle cover which exhibits excellent heat insulating effect and is free from spilling of water even if the receptacle is turned over and which enables opening and closing of the spout with small power, no matter whether the cup to which the cover is applied has a handle or not, to release the internal pressure when the spout is opened and secure inflow of the outside air through the air inlet, enabling smooth drinking of the water contained in the receptacle.

DISCLOSURE OF THE INVENTION

The present invention relates to a drinking receptacle cover comprising a slant cover plate having a top surface and a bottom surface and covering a heat insulating drinking receptacle at the open top, a rim surrounding the cover plate, a valve assembly having a valve element for opening and closing a spout formed at a lowest level portion of the cover plate adjacent to the rim, a push rod for operating the valve assembly, and a return spring for urging the push rod in the anti-actuating direction; the push rod being disposed to penetrate an insertion opening formed in the rim to be retractable along the bottom surface of the cover plate; an actuating lever, which is engaged with the outer end of the push rod to advance it into the inside of the rim, being pivotally located on the outer side of the rim; the actuating lever having an actuating section extending along the outer side of the receptacle; the valve assembly having an engaging arm to be engaged with the push rod and a closing arm having the valve element at the free end; the valve assembly being pivotally supported, by brackets protruding from the bottom surface of the cover plate, at the trunnions protruding from the lateral sides of the engaging arm.

Accordingly, in the state where the cover is applied to the receptacle, since the return spring urges the valve element of the valve assembly to seal the spout hermetically, the drinking receptacle shows high effect of insulating the temperature of the water contained in it, and also the water never spills out even if the receptacle is turned over.

When one drinks the water in the receptacle, if he or she holds the receptacle with the hand and pulls the actuating section of the actuating lever, for example, with the index finger, the spout is opened to permit drinking of the water, enabling stable holding of the drinking receptacle. Further, since the actuating section of the actuating lever is extended long downward along the outer wall of the receptacle, the actuating section of the actuating lever can be operated with a small power. Moreover, the actuating lever can be operated easily even if the cover is applied to a receptacle with a handle.

Meanwhile, the push rod has a similar cross-sectional portion having a cross section similar to that of the insertion opening and a nonsimilar cross-sectional portion having a cross section not similar to that of the insertion opening, so that the similar cross-sectional portion may be located in the insertion opening when the actuating lever is not operated and that the nonsimilar cross-sectional portion may be located in the insertion opening when the actuating lever is operated to utilize the clearance formed between the nonsimilar cross-sectional portion and the insertion opening as an air inlet.

Accordingly, compared with the structure in which the air inlet is opened and closed using a packing, the cover of the present invention enjoy merits in that the number of parts and the number of assembling steps can be reduced, that pressure rise in the cup when the actuating lever is not operated is prevented and that the inflow of outside air can be secured when the actuating lever is operated.

BEST MODE FOR CARRYING OUT THE INVENTION

Figure 1:
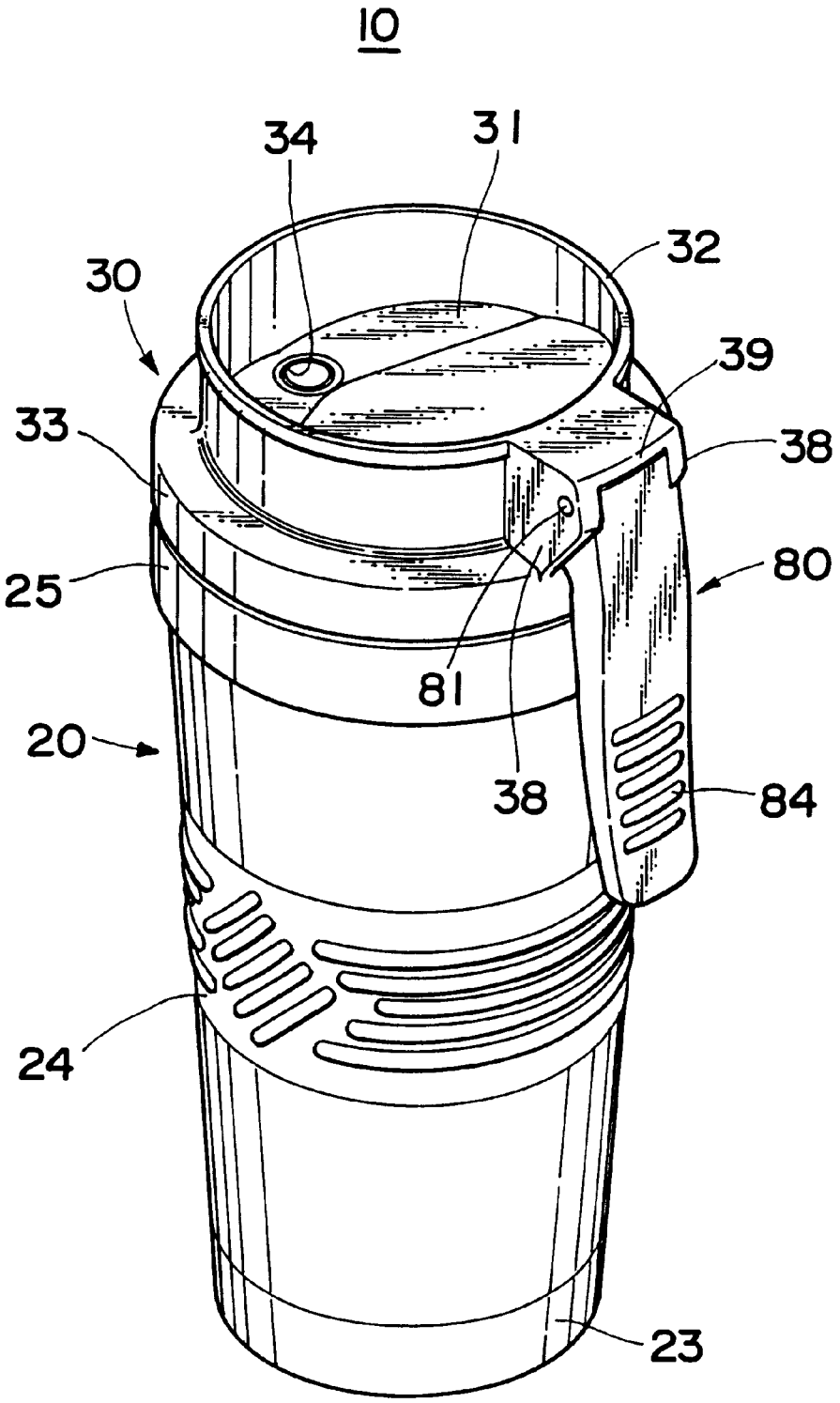
FIG. 1 is a perspective view showing the drinking receptacle fitted with a cover according to one embodiment of the present invention.

The present invention will be described below more specifically based on one embodiment shown in FIGS. 1 to 6. A drinking receptacle 10 comprises a cup 20 with no handle and a cover 30 covering the open top of the cup 20. The cup 20 has a vacuum heat insulating structure formed between an outer cup 21 and an inner cup 22, with a bottom member 23 at the bottom, a non-slip 24 formed along the circumference of the barrel at around the middle part and a shoulder member 25 formed along the outer circumference of the open top. The cover 30 is removably screw-fitted to the shoulder member 25.

The cover 30 contains a slant cover plate 31 having top surface and a bottom surface and covering the open top of the cup 20 and a rim 32 surrounding the cover plate 31. The rim 32 is provided with a screw-fitting portion 33 to be screw fitted to the shoulder member 25. The spout 34 is formed in the cover plate 31 at the lowest level portion adjacent to the rim 32.

This cover 30 is provided with a spout closing mechanism 40 which opens and closes the spout 34. This mechanism 40 contains a valve assembly 50 for opening and closing the spout 34, a push rod 60 for actuating the valve assembly 50, a return spring 70 for urging the push rod 60 outward (anti-actuating direction) through the rim 32 and an actuating lever 80 for pushing the push rod 60.

The valve assembly 50, which is located under the bottom surface of the cover plate 31, has a vertical engaging arm 51 and a closing arm 52 extended from the engaging arm 51 substantially horizontally. The engaging arm 51 has a pair of trunnions 53 protruding from the lateral sides and a push rod engaging groove 54 formed at a part higher than the trunnions 53. The engaging arm 51 is pivotally supported at the trunnions 53 by a pair of brackets 35 protruding downward from the bottom surface of the cover plate 31. The closing arm 52 extends from the engaging arm 51 along the bottom surface of the cover plate 31 toward the spout and has at the free end a convex valve element 55 which can be inserted to the spout 34. An annular packing 56, which is to be brought into intimate contact with the lower peripheral portion of the spout 34, is fitted to the proximal portion of the valve element 55. The closing arm 52 is pivoted vertically with the pivotal movement of the engaging arm 51.

The brackets 35 are formed integrally with the bottom surface of the cover plate 31 on the higher level side and with the internal surface of the rim 32. Each bracket 35 has an open bottom trunnion fitting groove 351 and a fitting protrusion 352 to be fitted in a closing member 36 which is applied to the bottom of the trunnion fitting groove 351 to close it. The closing member 36 has a pair of trunnion supporting sections 361 to be fitted in the trunnion fitting grooves 351 respectively and a pair of fitting openings 362 to which the fitting protrusions 352 are press fitted.

To describe fitting of these brackets 35 to the valve assembly 50, the trunnions 53 are inserted to the trunnion fitting grooves 351 from the open bottoms, and then the closing member 36 is applied to the bottoms of the brackets 35. With the trunnions 53 being supported by the trunnion supporting sections 361, the fitting protrusions 352 are inserted to the fitting openings 362, respectively, to fit the closing member 36 to the brackets 35 and close the trunnion fitting grooves 351 with the closing member 36, followed by fixing of the closing member 36 to the brackets 35 using fixing means such as welding or press fitting to pivotally support the valve assembly 50.

The push rod 60 penetrates an insertion opening 37 having a circular cross section formed in the rim 32 adjacent to the higher level side of the cover plate 31 to be retractable along the bottom surface of the cover plate 31. This push rod 60 has an increased diameter shaft portion 61 penetrating the insertion opening 37 and a reduced diameter shaft portion 62 to be located on the bottom surface of the cover plate 31.

The increased diameter shaft portion 61 has a cross-shaped nonsimilar cross-sectional portion 63 which is not similar to the cross section of the insertion opening 37, and this portion 63 contains at a certain part a circular similar cross-sectional portion 64 which is similar to the cross section of the insertion opening 37. This portion 64 has a diameter slightly smaller than the diameter of the insertion opening 37 to form a very small clearance between the outer circumference of the portion 64 and the inner circumference of the insertion opening 37.

An engaging portion 66 having a receiving flange 65 for receiving the return spring 70 is formed at the outer end of the increased diameter shaft portion 61. The engaging portion 66 has a groove 661 which is engageable with the actuating lever 80. The return spring 70 is fitted around the increased diameter shaft portion 61 present between the outer surface of the rim 32 and the receiving flange 65 as compressed between them.

The reduced diameter shaft portion 62 has an engaging flange 67, to be engaged with the valve assembly 50, formed at a position spaced a little away from the step of the increased diameter shaft portion 61. A circular cross-sectional shaft portion 68 is present between the step of the increased diameter shaft portion 61 and the engaging flange 67 and is engaged with the push rod engaging groove 54 of the engaging arm 51. Meanwhile, a shaft nose 69 protruding through the engaging flange 67 is formed by chamfering and flattening the shaft having a circular cross section at the lateral sides. The shaft nose 69 thus formed is inserted to a guide groove 391 of a bridge 39 formed between the brackets 35.

This guide groove 391 is formed such that it may be slightly wider than the width between the lateral sides of the shaft nose 69 and narrower than the width between the top surface and the bottom surface of the shaft nose 69, so that the shaft nose 69 can be inserted to the guide groove 391 only when the groove 661 of the engaging section 66 is oriented horizontally, thus serving as an orientation guide when the push rod 60 is incorporated into the cover 30 and preventing crosswise slippage of the push rod 60 when it is advanced into and retracted from the cover 30 through the rim 32.

The actuating lever 80 is pivotally supported by a support shaft 81 borne by a pair of brackets 38 formed on the outer surface of the rim 32 at the higher level side opposite to the spout 34 formed in the cover plate 31. An actuating section 82 of the actuating lever 80 is extended downward along the outer surface of the barrel as long as to the proximity of the non-slip 24. The actuating section 82 has an engaging section 83, which engages with the groove 661 of the engaging portion 66 of the push rod 60, formed on the inner side of the lever 80 slightly below the fulcrum of the support shaft and also several ridges formed, as a finger catch 84, on the outer side at a lower part.

Figure 2:
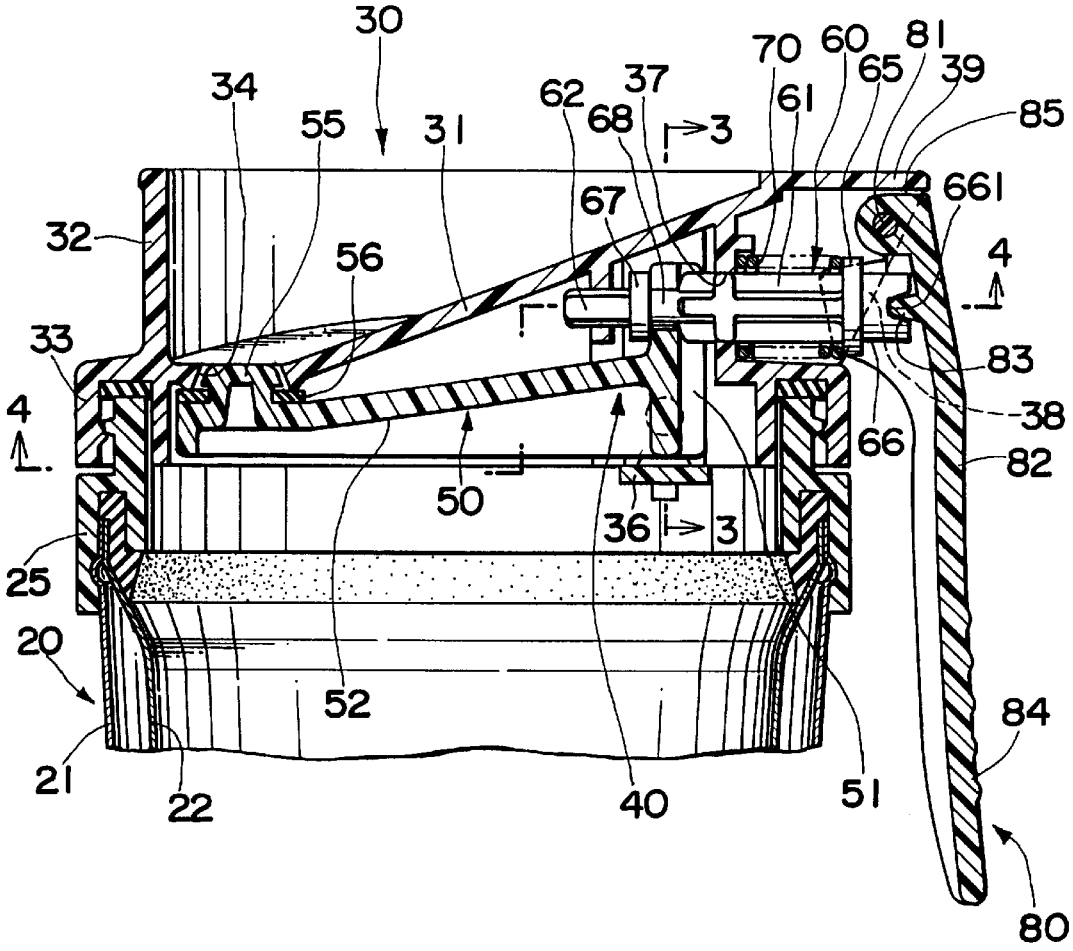
FIG. 2 is a cross-sectional view of the cover according to the embodiment of the present invention.
Figure 3:
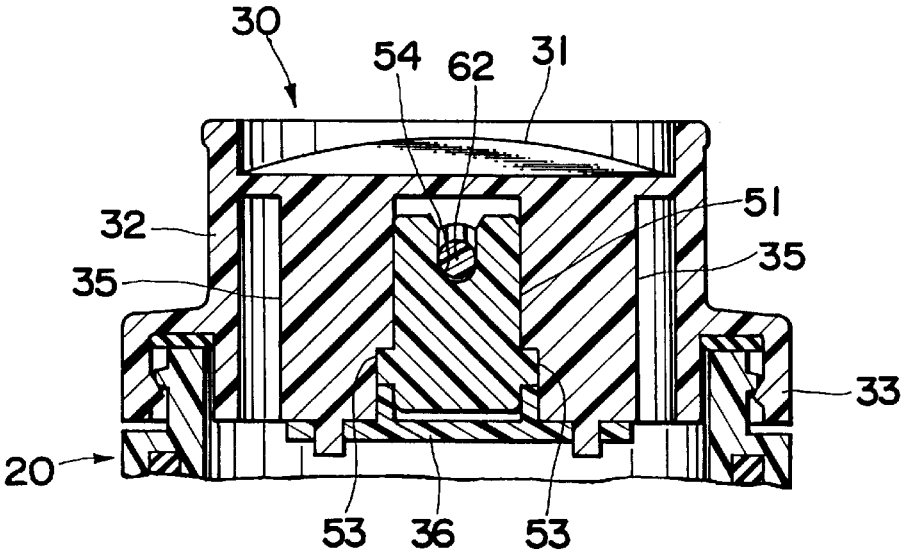
FIG. 3 is a cross-sectional view taken along the line 3—3 in FIG. 2.
Figure 4:
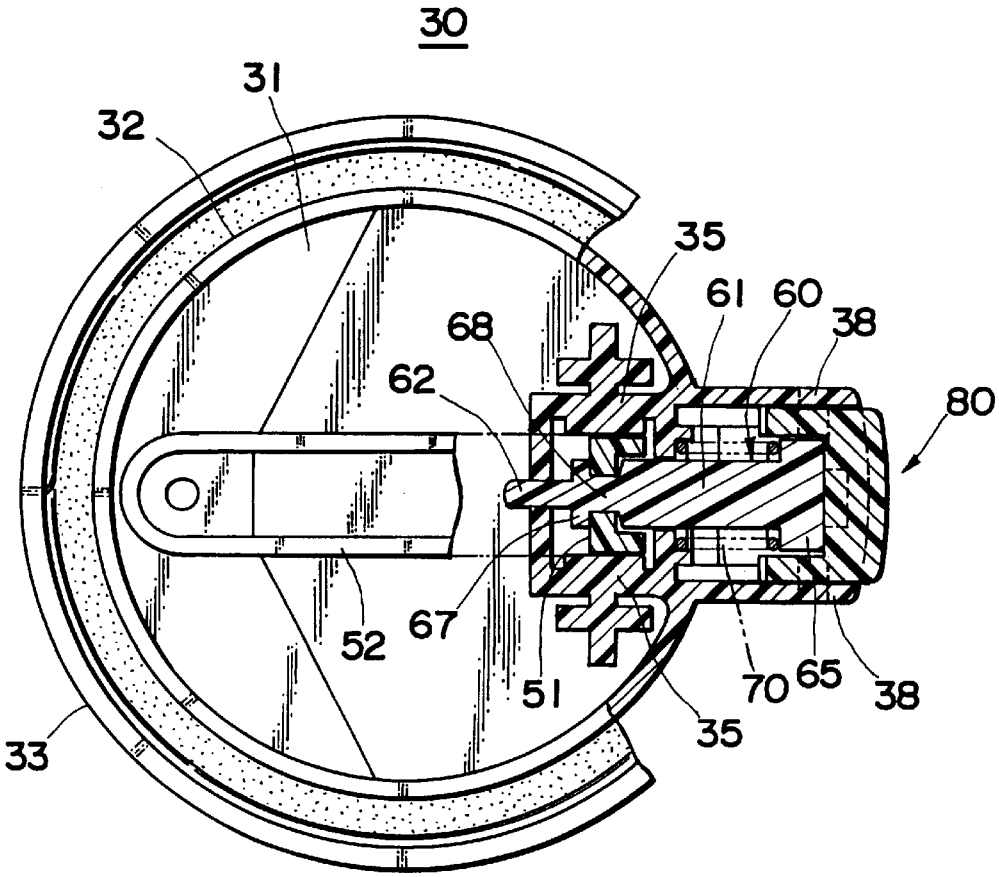
FIG. 4 is a cross-sectional view taken along the line 4—4 in FIG. 2.

In the closing mechanism 40 having such a constitution, since the push rod 60 is urged by the return spring 70 outward through the rim 32 in the state where the cover 30 is fitted on the cup 20, the actuating lever 80 is abutted against a bridge 39 connecting the upper end faces 85 of the brackets 38 to each other to allow the actuating section 82 to locate at the anti-actuating position spaced away from the barrel of the cup 20, as shown in FIG. 2. Meanwhile, in the valve assembly 50, since the engaging arm 51 is pulled outward through the rim 32 by the push rod 60, an upward torque is acted upon the closing arm 52 to allow the packing 56 of the valve element 55 to close off the spout 34. The similar cross-sectional portion 64 of the increased diameter shaft portion 61 of the push rod 60 is located in the insertion opening 37 to close it. Accordingly, since the cup 20 is sealed hermetically with the cover 30, it shows excellent effect of insulating the temperature of the water in contained in the receptacle 10, and the water does not spill out even if the drinking receptacle 10 is turned over.

Figure 5:
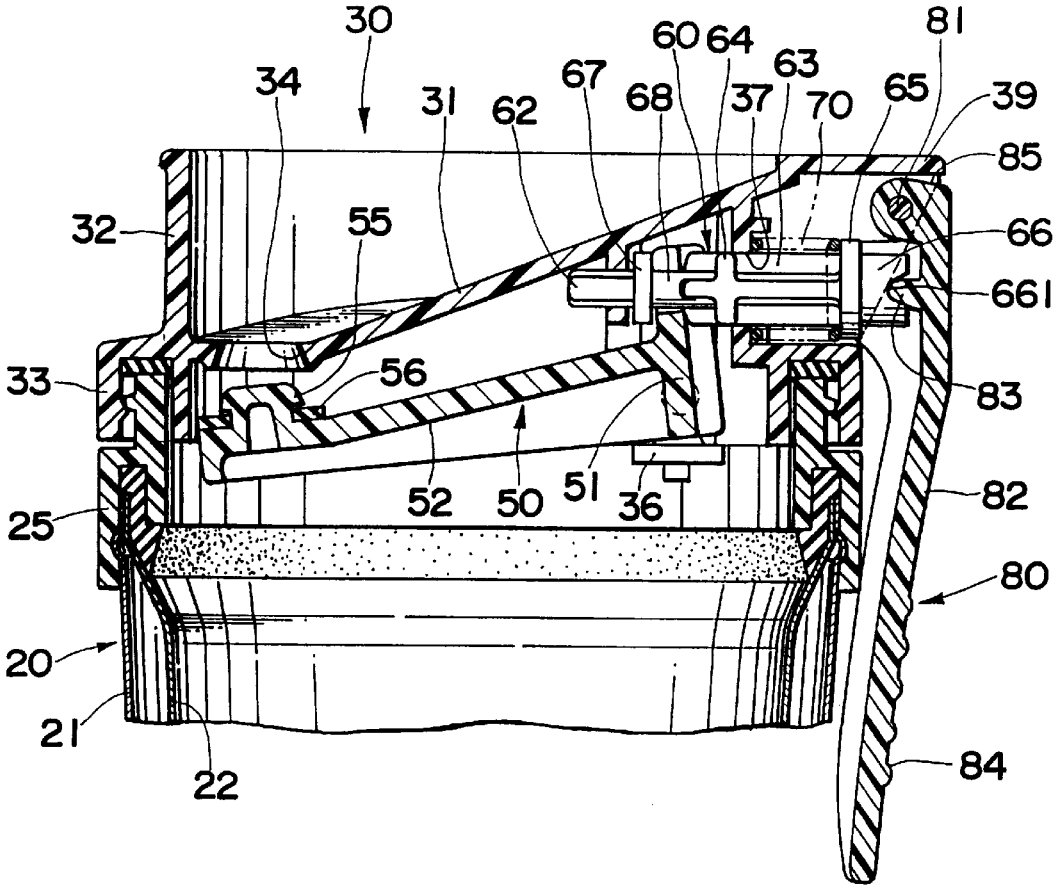
FIG. 5 is a cross-sectional view of the cover showing the state where the spout is open.
Figure 6:
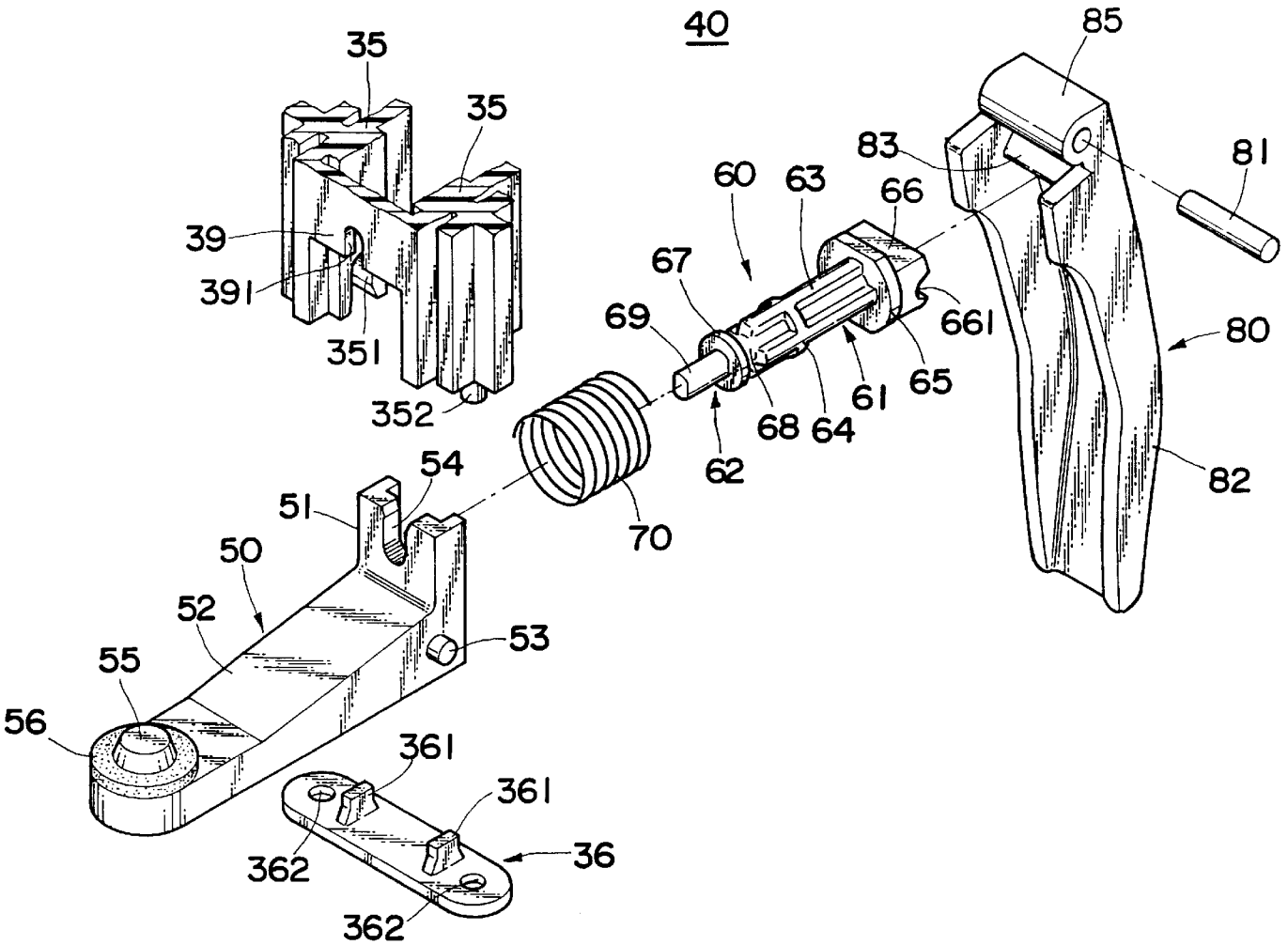
FIG. 6 is an exploded perspective view of parts constituting the spout closing mechanism.

If the cup 20 is held with five fingers at the non-slip 24 formed substantially at the middle of the barrel of the cup 20 and the actuating section 82 is pulled toward the cup 20, for example, with the index finger positioned at the finger catch 84, the push rod 60 is thrust toward the spout to pivot the valve element 50 on the trunnions 53 serving as fulcrums and to bring the packing 56 of the valve element 55 away from the spout 34 to open it, as shown in FIG. 5, permitting drinking of the water.

In this instance, when the push rod 60 is shifted toward the spout, the nonsimilar cross-sectional portion 63 is located in the insertion opening 37, so that the clearance formed between the outer circumference of the portion 63 and the inner circumference of the insertion opening 37 serves as an air inlet and the cross-sectional area of the air inlet is increased, permitting inflow of the outside air through the air inlet into the cup 20 and smooth drinking of the water.

If the gripping of the actuating section 82 is released, the return spring 70 urges the valve assembly 50, push rod 60 and actuating lever 80 to reset to the original positions respectively, and the packing 56 of the valve element 55 seals the spout 34 hermetically.

As described above, since one can drink the water in the cup 20 smoothly by holding the cup 20 at the non-slip 24 formed substantially at the middle of the barrel and pulling the actuating section 82 of the actuating lever 80 extended to the proximity of the non-slip 24, the cup 20 can be held stably. Further, in the actuating lever 80, since the ratio of the distance from the support shaft 81 to the finger catch 84 to the distance from the support shaft 81 to the engaging section 83 to be engaged with the push rod 60 is great, the actuating lever 80 can be operated with a small power even if the urging force of the return spring 70 is great. Further, if the cover 30 is applied to a cup with a handle, the actuating lever 80 can be operated easily.

In the state where the similar cross-sectional portion 64 of the push rod 60 is located inside the insertion opening 37 when the actuating lever 80 is not operated, for example, even if a cup 20 containing hot water is closed by screw-fitting the cover 30 and is shaken to cause increase in the internal pressure of the cup 20, the pressure can be released through the very small clearance present between the outer circumference of the similar cross-sectional portion 64 and the inner circumference of the insertion opening 37. Besides, when the actuating lever 80 is operated, the nonsimilar cross-sectional portion 63 of the push rod 60 is located in the insertion opening 37 to define an air inlet and secure inflow of the outside air, permitting smooth drinking of the water. Accordingly, compared with the structure in which the air inlet is opened and closed using a packing, the cover of the present invention enjoy merits in that the number of parts and the number of assembling steps can be reduced, that pressure rise in the cup 20 is prevented when the actuating lever is not operated and that the inflow of outside air can be secured when the actuating lever is operated.

Incidentally, the shape of the nonsimilar cross-sectional portion 63 may have a triangular cross section, a square cross section or the like which is not similar to the circular cross section of the insertion opening in the present embodiment. Meanwhile, in the case of an insertion opening having a square cross section, the shape of the nonsimilar cross-sectional portion 63 may have a triangular cross section, a circular cross section, a crossed cross section and the like.

Figure 7:
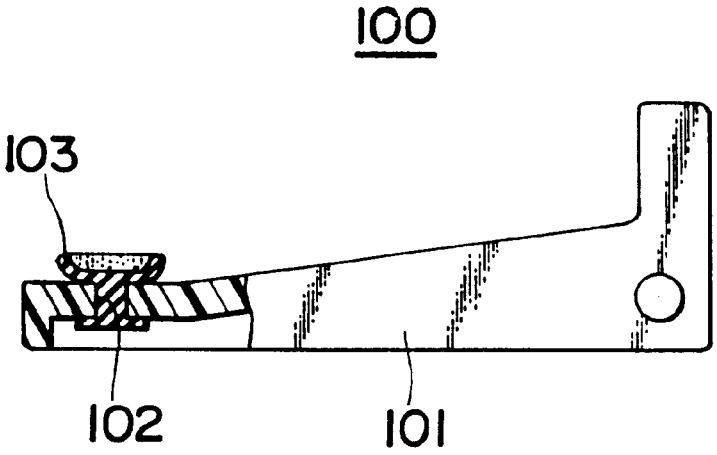
FIG. 7 is a partially sectional front view showing a valve assembly according to another embodiment.
Figure 8:
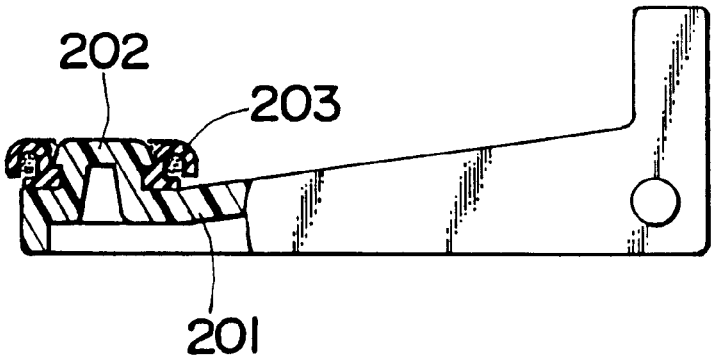
FIG. 8 is a partially sectional front view showing a valve assembly according to still another embodiment.

FIGS. 7 and 8 show different embodiments of valve assembly for sealing the spout 34 hermetically. In the valve assembly 100 shown in FIG. 7, a packing fitting opening 102 is formed at the free end of a closing arm 101, and a plate-like packing 103 is fitted in the opening 102 to bring the upper edge of the packing 103 into intimate contact with the lower peripheral portion of the spout to seal hermetically the spout from the inside of the cover plate. Accordingly, the spout can be sealed hermetically, even if the bottom surface around the spout is flat.

Meanwhile, in the valve assembly 200 shown in FIG. 8, a convex valve element 202 having a diameter smaller than that of the spout is formed at the free end of a closing arm 201, and a U ring packing 203 having an inverted substantially U-shaped cross section is applied to the convex valve element 202. The packing 203 has a sealing portion to be brought into intimate contact with the lower periphery of the spout and is substantially as tall as the convex valve element 202, with the outer periphery being folded back, so that the sealing portion may be brought into intimate contact with the lower peripheral surface of the spout to close off the spout. Accordingly, the spout can be sealed hermetically even if the lower peripheral surface around the spout is flat.

What is claimed is:

1. A drinking receptacle cover comprising:

a slant cover plate having a top surface and a bottom surface and covering a heat insulating cup at the open top;

a rim surrounding the cover plate;

a valve assembly having a valve element for opening and closing a spout formed at a lowest level portion of the cover plate adjacent to the rim;

a push rod for operating the valve assembly; and a return spring for urging the push rod in the anti-actuating direction;

the push rod being disposed to penetrate an insertion opening formed in the rim to be retractable along the bottom surface of the cove plate;

an actuating lever, which is engaged with an outer end of the push rod to advance it into the inside of the rim, being pivotally located on an outer side of the rim;

the actuating lever having an actuating section extending along the outer side of the receptacle;

the valve assembly having an engaging arm to be engaged with the push rod and a closing arm having the valve element at the free end;

the valve assembly being pivotally supported, by brackets protruding from the bottom surface of the cover plate, at trunnions protruding from lateral sides of the engaging arm, the return spring being disposed between an outer surface of the rim and the receiving flange of the push rod.

2. The drinking receptacle cover according to claim 1, wherein the push rod has a similar cross-sectional portion having a cross section similar to that of the insertion opening and a nonsimilar cross-sectional portion having a cross section not similar to that of the insertion opening, the similar non-sectional portion having a diameter slightly smaller than a diameter of the insertion opening to form a very small clearance between an outer circumference of the similar non-sectional portion and an inner-circumference of the insertion opening, so that the similar cross-section portion may be located in the insertion opening when the actuating lever is not operated and that the non-similar cross-sectional portion may be located in the insertion opening when the actuating lever is operated to utilize the clearance formed between the nonsimilar cross-section portion and the insertion opening as an air inlet.

3. The drinking receptacle cover according to claim 1, wherein the engaging arm extends vertically, the push rod is engaged at the end of the engaging arm, the closing arm extends substantially horizontally and the distance between the trunnions of the closing arm and the valve element is longer than that between the trunnions of the engaging arm and the engaging portion of the push rod.

* * * * *

UNITED STATES PATENT AND TRADEMARK OFFICE

CERTIFICATE OF CORRECTION

PATENT NO. : 6,098,834
DATED : August 8, 2000
INVENTOR(S) : Kunio Hatsumoto et al.

It is certified that error appears in the above-identified patent and that said Letters Patent is hereby corrected as shown below:

Column 8,
Lines 6 and 9, change “non-sectional” to -- cross-sectional --.

Signed and Sealed this

Twentieth Day of September, 2005

JON W. DUDAS
*Director of the United States Patent and Trademark Office*